US006286531B1

(12) United States Patent
Joo-Tai

(10) Patent No.: US 6,286,531 B1
(45) Date of Patent: Sep. 11, 2001

(54) TENT POLE WITH PROTECTIVE COVERING

(75) Inventor: Choi Joo-Tai, Seongnam (KR)

(73) Assignee: Sedo Camping Co., Ltd. (KR)

( * ) Notice: Subject to any disclaimer, the term of this patent is extended or adjusted under 35 U.S.C. 154(b) by 0 days.

(21) Appl. No.: 09/433,688

(22) Filed: Nov. 4, 1999

(30) Foreign Application Priority Data

Nov. 6, 1998 (KR) ..... 98-21558

(51) Int. Cl.[7] ..... E04H 15/40
(52) U.S. Cl. ..... 135/114; 135/127
(58) Field of Search ..... 135/114, 127, 135/115, 125, 156, 139, 120.3

(56) References Cited

U.S. PATENT DOCUMENTS 3,448,748 * 6/1969 Walrave ..... 135/114
4,979,531 * 12/1990 Toor ..... 135/104
5,029,847 * 7/1991 Ross ..... 135/114
5,435,024 * 7/1995 Capshaw ..... 135/127
5,590,674 * 1/1997 Eppenbach ..... 135/114
5,628,336 * 5/1997 Lee ..... 135/114
5,683,199 * 11/1997 Tehan ..... 135/127
5,732,726 * 3/1998 Lee ..... 135/114
5,771,912 * 6/1998 Swetish ..... 135/87
6,042,297 * 3/2000 Lah ..... 135/114

* cited by examiner

*Primary Examiner*—Beth A. Stephan
(74) *Attorney, Agent, or Firm*—Pendorf & Cutliff

(57) ABSTRACT

Provided with a tent pole including pipes formed of a fiberglass-reinforced plastic and combined with each other by means of a coupler, the tent pole including: a protective covering having the form of a tube of a soft synthetic resin, for coating the circumferential surface of the pipes; and a finishing portion formed by shrinking both ends of the protective covering by heating to enclose both ends of the pipes, for preventing removal of the protective covering from the pipes.

5 Claims, 3 Drawing Sheets

TENT POLE WITH PROTECTIVE COVERING

BACKGROUND OF THE INVENTION

1. Field of the Invention

The present invention relates to a pole for a tent used by campers or children playing indoor or outdoor and, more particularly, to a pole with a protective covering, used for a tent, in which the pole formed of a fiberglass-reinforced plastic is coated with a protective covering tube of a synthetic resin to prevent uses from being damaged from keen glass fibers removed from the surface of the pole when breaking or bending the pole due to a shock, or during installation or disassembly of the tent, thereby preventing inhalation of the glass fibers by the users.

2. Discussion of Related Art

Poles for a tent are required to maintain their strength and elasticity and usually fabricated from a fiberglass reinforced plastic (FRP).

Especially, since the fiberglass-reinforced plastic is in nature composed of glass fibers, light-weighted and highly excellent in strength, abrasion resistance and workability, they are widely used for a body material of small-sized vessels, a material of aircraft, a bathtub, a tent pole, a fishing rod, and the like. A pole made of the fiberglass-reinforced plastic used for a tent is light and excellent in elasticity and has a long lifetime even when it is fabricated very thin. Thus, such a pole has a great strength for supporting the tent but relatively less dimension with respect to the tent so that it is advantageously convenient to maintain and carry the tent.

However, the above-mentioned tent pole made of the fiberglass-reinforced plastic is ready to be cracked when broken through carelessness or aged after long time uses. At this time, a number of fibers are separated from the broken pole and leave such keen sections in the pole as to damage the hands or body of a user or tear the cloth of the tent.

In particular, glass fibers are easily stuck into the user's skin or introduced into the body through inhalation. The glass fibers are very keen and hard to get off from the organs in the human body so that the damaged portions of the body easily become inflamed and require an operation for the inflammation.

Furthermore, although it is urged to have children playing with a soft-feeling material such as wood in the kindergarten based on the principle that the feeling in the hands of the children affect the temper of the children, the fiberglass-reinforced plastic gives a feeling of coldness to the children.

SUMMARY OF THE INVENTION

Accordingly, an object of the present invention is to provide a pole with an elastic protective covering, used for a tent, in which the pole consisting of a fiberglass-reinforced plastic is coated with the protective covering, thereby increasing strength of the pole without degradation of elasticity to prevent breaking of the pole. and protecting a user against keen sections on the broken or cracked pole as well as preventing damages on the cloth of the tent by the keen sections. Especially, the present invention pole is designed not to release glass fibers separated from the surface thereof lest that the glass fibers should be introduced into the body of the user through inhalation.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

DETAILED DESCRIPTION OF PREFERRED EMBODIMENT

Hereinafter, the present invention will be described in detail with reference to the accompanying drawings.

Figure 1:
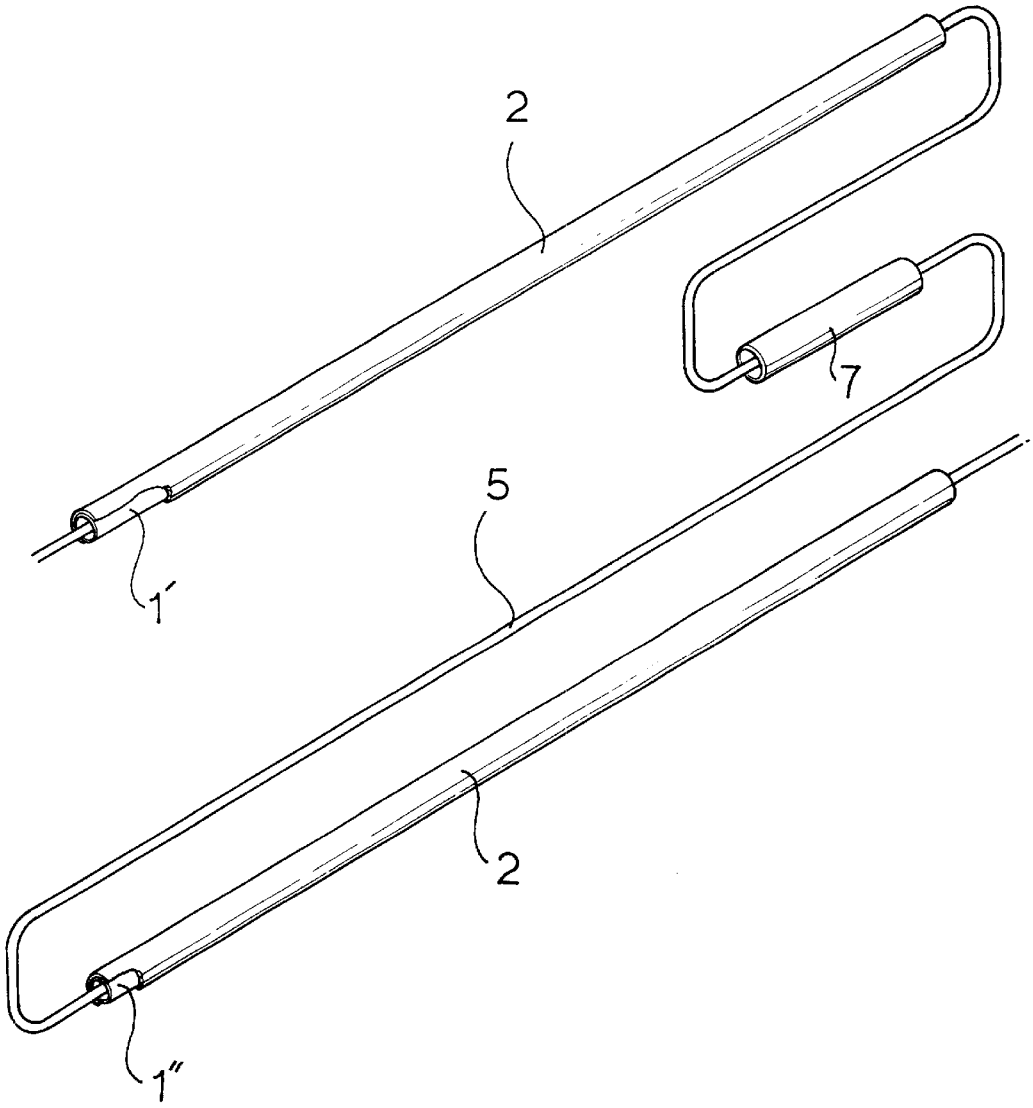
FIG. 1 is an exploded perspective view of the present invention.

FIG. 1 is an exploded perspective view of a pole used for a tent in the present invention and FIG. 2 is a cross-sectional view of it.

Pole 1 used for a tent has pipes 1' and 1" made of a fiberglass-reinforced plastic. The pipes 1' and 1" are combined with each other by means of a coupler 7.

The pipes 1' and 1" are coated with a protective covering 2 having the form of a tube made of a soft synthetic resin. The pipe 1' has a finishing portion 3 formed by shrinking both ends of the protective covering 2 by heating. The finishing portion 3 encloses both ends 4 and 4' of the pipe 1' lest the protective covering 2 should get removed from the pipe 1'.

At both ends of the pole 1, the pipes 1' and 1" have a second finishing portion 3' formed by heating the one end of the protective covering 2. To the finishing portion 3' is fixed a lock 6 of an elastic cord 5.

Now, a detailed description will be made as to an operation of the present invention with reference to the accompanying drawings.

Figure 2A:
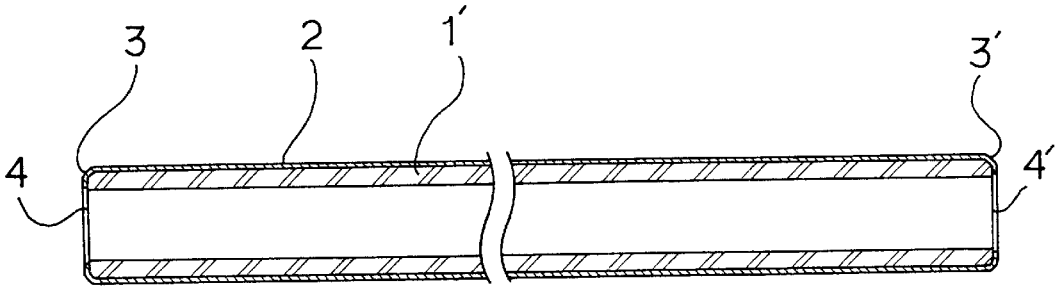
FIG. 2A is an enlarged cross-sectional view of the present invention.
Figure 2B:
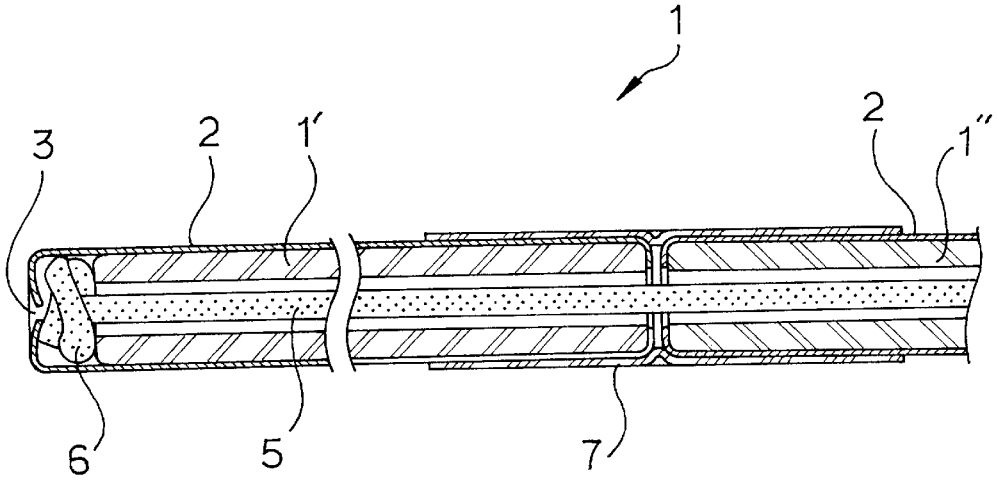
FIG. 2B is an illustrative diagram of an embodiment of the present invention.

FIG. 2A is an enlarged cross-sectional view of the present invention and FIG. 2B is a cross-sectional view of an embodiment of the present invention. The protective covering 2 is formed closely on the circumferential surface of the pipes 1' and 1". The both ends of the protective covering 2 are shrunk by heating or other known shrinking methods to form the finishing portion 3. Here, the finishing portion 3 has a section smaller than the outer diameter of the both ends 4 and 4" of the pipes 1 and 1" but larger than the inner diameter of them. This finishing portion 3 prevents removal of the protective covering 2 from the smooth surface of the tent pipes 1' and 1" as well as drift of the protective covering 2 away from the pipes 1' and 1" even when the pipes 1' and 1" are broken or bent.

The coupler 7 is fixed at the one end of the pipes 1' and 1" and the elastic cord 5 is inserted into the pipes 1' and 1" to combine the pipes 1' and 1".

Here, the elastic cord 5 couples the set of poles 1 to each other and allows the respective pipes 1' and 1" to be easily assembled or disassembled by means of the coupler 7 during installation or disassembly of the tent.

In each set of the poles 1, the elastic cord 5 is fixed at the one end of the pipes 1' and 1" so as not to be slipped into the pipes 1' and 1". Although a lock 6 of the elastic cord 5 is conventionally inserted into the one end of the pipes 1' and 1" with a separate cap, the present invention provides the finishing portion 3' formed by shrinkage of the protective covering 2 to fix the lock 6 of the elastic cord 5 firm. This finishing portion 3' prevents removal of the elastic cord 5 from the pipes 1' and 1" or release of the lock 6 of the elastic cord 5.

Figure 3:
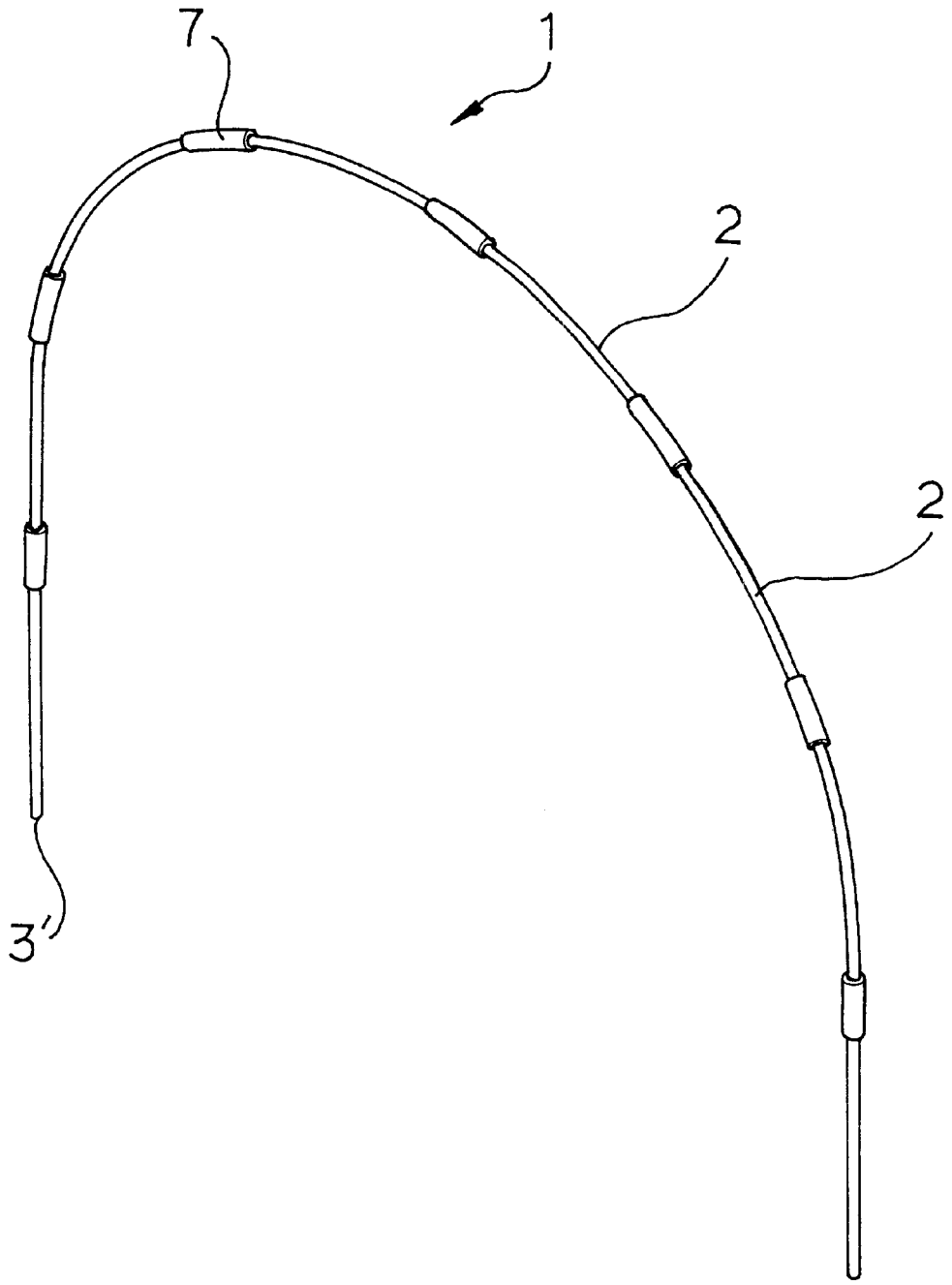
FIG. 3 is an illustrative diagram showing a station that the present invention is in use.

As illustrated in FIG. 3, a set of tent poles 1 are coupled to each other to form a support base for easier installation of the tent. The poles 1 are coated with the protective covering 2 to strengthen the overall elasticity of the poles 1. This elongates the lifetime of the poles 1 and secures safety of children.

As described above, the present invention tent pole with a protective covering is designed not to expose keen glass fibers to the outside even when it is broken or cracked and thereby protect users as well as cloth of the tent. The pole can also protect the body of a user against glass fibers separated from the surface of the pole and give a feeling of softness to the children playing with it, not adversely affecting the disposition of the children.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A tent pole having first and second ends, the tent pole comprising:

pipes formed of a fiberglass-reinforced plastic, each pipe having a first end, a second end and a circumferential surface, each pipe having a soft synthetic resin protective cover covering said entire circumferential surface;

couplers adapted for coupling adjacent pipes to each other; and an elastic cord extending through said pipes from said first end of said tent pole to said second end of said tent pole to combine the pipes to each other;

wherein said protective cover is joined to the respective ends of said pipes by heat shrinking, thereby protecting the respective pipe ends.

2. The tent pole as claimed in claim 1, wherein said elastic cord extends beyond the respective ends of the pole, and wherein said extending elastic cord is covered by heat shrinking said protective cover.

3. The tent pole as claimed in claim 1, wherein the protective covering comprises polypropylene (PP).

4. The tent pole as claimed in claim 1, wherein the protective covering comprises polyethylene (PE).

5. The tent pole as claimed in claim 1, wherein said elastic cord extends beyond the respective ends of the pole, wherein said extending ends of said elastic cord are respectively tied into a knot, wherein said knots are covered by heat shrinking said protective cover.

* * * * *